US011530574B2

(12) United States Patent
Fjelde

(10) Patent No.: US 11,530,574 B2
(45) Date of Patent: Dec. 20, 2022

(54) METHOD FOR GENERATING A FREEROOM FOR A MAST ELEMENT

(71) Applicant: Comrod AS, Tau (NO)

(72) Inventor: Ole Gunnar Fjelde, Tau (NO)

(73) Assignee: Comrod AS, Tau (NO)

( * ) Notice: Subject to any disclaimer, the term of this patent is extended or adjusted under 35 U.S.C. 154(b) by 265 days.

(21) Appl. No.: 16/764,451

(22) PCT Filed: Nov. 7, 2018

(86) PCT No.: PCT/NO2018/050268
§ 371 (c)(1),
(2) Date: May 15, 2020

(87) PCT Pub. No.: WO2019/098844
PCT Pub. Date: May 23, 2019

(65) Prior Publication Data

US 2020/0362636 A1 Nov. 19, 2020

(30) Foreign Application Priority Data

Nov. 17, 2017 (NO) ..... 20171829

(51) Int. Cl.
*E21B 7/00* (2006.01)
*E04H 12/22* (2006.01)
*E04H 12/34* (2006.01)

(52) U.S. Cl.
CPC ..... *E21B 7/00* (2013.01); *E04H 12/22* (2013.01); *E04H 12/347* (2013.01)

(58) Field of Classification Search
CPC . E21B 7/00; E21B 7/001; E21B 7/002; E21B 7/003; E04H 12/22; E04H 12/347
See application file for complete search history.

(56) References Cited

U.S. PATENT DOCUMENTS 3,778,179 A * 12/1973 Rivas ..... B23B 51/04 125/20
4,671,367 A 6/1987 Brunsing et al.
(Continued)

FOREIGN PATENT DOCUMENTS

CH 662156 9/1987
CN 105604001 5/2016
(Continued)

OTHER PUBLICATIONS

Norwegian Search Report for NO 20171829, dated May 28, 2018.
(Continued)

*Primary Examiner* — Nkeisha Smith
(74) *Attorney, Agent, or Firm* — Andrus Intellectual Property Law, LLP

(57) ABSTRACT

A method is for generating a freeroom for a mast element in a ground. The method includes the steps: a) drilling a first annular recess into the ground, the first recess having: a first diameter; and a first depth; b) drilling a second annular recess in the ground, the second recess being arranged to receive the mast element, and the second recess: having a diameter which is smaller than the first diameter; having a second depth which is larger than the first depth; surrounding a first core of the ground; and being surrounded by the first recess; wherein there is, defined between the first recess and the second recess, a second core which can be removed to generate a freeroom.

13 Claims, 4 Drawing Sheets

(56) References Cited

U.S. PATENT DOCUMENTS

| | | | | |
|---|---|---|---|---|
| 5,205,521 | A | 4/1993 | Smith et al. | |
| 6,234,719 | B1 * | 5/2001 | Roynestad | E21B 7/00 405/253 |
| 7,546,886 | B2 * | 6/2009 | Benzie | E21B 7/208 166/380 |
| 2007/0127989 | A1 * | 6/2007 | Elliott | E02D 27/42 405/231 |
| 2018/0155988 | A1 * | 6/2018 | Fonseca Ocampos | E21B 33/14 |

FOREIGN PATENT DOCUMENTS

| | | |
|---|---|---|
| CN | 105649012 | 6/2016 |
| CN | 107059914 | 8/2017 |
| EP | 3073044 | 9/2016 |
| GB | 2429229 | 2/2007 |
| JP | H08135355 | 5/1996 |
| JP | 2001349167 | 12/2001 |
| JP | 2013057204 | 3/2013 |
| NO | 311184 | 10/2001 |
| RU | 1793752 | 4/1995 |
| WO | 2004101914 | 11/2004 |
| WO | 2005005752 | 1/2005 |
| WO | 2007020445 | 2/2007 |
| WO | 2008093482 | 8/2008 |
| WO | 2017142419 | 8/2017 |

OTHER PUBLICATIONS

International Search Report and the Written Opinion for PCT/NO2018/050268, dated Jan. 28, 2019.

Examination Report for Corresponding Australian Patent Application No. 2018367808, dated Feb. 15, 2021.

Extended European Search Report for Corresponding EP Application No. 18879222.0, dated Jul. 14, 2021.

* cited by examiner

A–A

B-B

C–C

METHOD FOR GENERATING A FREEROOM FOR A MAST ELEMENT

CROSS-REFERENCE TO RELATED APPLICATIONS

This application is the U.S. national stage application of International Application PCT/N02018/050268, filed Nov. 7, 2018, which international application was published on May 23, 2019, as International Publication WO 2019/098844 in the English language. The International Application claims priority of Norwegian Patent Application No. 20171829, filed Nov. 17, 2017. The international application and Norwegian application are both incorporated herein by reference, in entirety.

FIELD

The invention relates to a method for generating a freeroom around a mast element in a ground.

BACKGROUND

When securing a mast to a ground, a recess adapted for receiving a mast element may be established. The mast element may be a mast or a foundation for a mast. The mast element may be solid or hollow. The mast element may be formed from wood, metal, concrete, composite or a combination of said materials.

When recessing in an unconsolidated ground, for example moraine, clay or silt, it is normal to form an open recess, for example by means of a spade or an excavator. The mast element is arranged in the recess which is then filled up with suitable masses so that the mast element becomes stable and fixed to the ground. Alternatively, the recess may be filled with concrete. In the concrete, a recess may be formed for the mast element, or an attachment for the mast element may be fixed, for example several pins adapted for attachment to a flange arranged on the mast element.

Patent document GB2429229 describes the establishment of a tubular groove in the ground, hereinafter referred to as a slot groove. The slot groove is arranged to receive a tubular element, for example a mast element. The slot groove surrounds a central core of material. When receiving a hollow mast element, the core may be intact, or it may be removed. The slot groove may be formed by using a slot drill connected to a drill rig.

To position and fix the mast element there may be a need for a freeroom on the outside of the mast element to make room for a positioning tool, for example, or some other implement. A freeroom may also be necessary to achieve a necessary clearance to the terrain around the mast element. On flat ground, there is normally sufficient freeroom around the mast element. In a rugged or uneven terrain, for example where a mast is to be arranged near a mountain or a cliff, it may be necessary to generate a freeroom. Establishing the freeroom may include using an excavator and using explosives.

An open recess will normally have a transverse dimension which is larger than the diame ter of the mast element, and the freeroom is usually generated at the same time as the open recess is being formed, and by the same equipment, for example said excavator.

A freeroom around a hollow mast element arranged in a slot groove is typically established by the formation of a surface, which is larger than the diameters of the slot and the mast element, before the slot is formed. The surface is usually formed by an excavator. Thereby the formation of a slot groove with a freeroom requires both a drill rig and an excavator.

The mast elements are often established on a mountain or in rugged terrain far from a road, where it is often necessary to transport the equipment by a helicopter or a cross-country vehicle. To reduce the amount of equipment to be transported, it is desirable to be able to establish a freeroom around a slot in a simpler way than it is today. At the same time, it is desirable that the freeroom should not be larger than necessary, so that unnecessary scars in the terrain are prevented.

SUMMARY

The invention has for its object to remedy or reduce at least one of the drawbacks of the prior art or at least provide a useful alternative to the prior art.

The object is achieved through the features that are specified in the description below and in the claims that follow.

The invention is defined by the independent claims. The dependent claims define advantageous embodiments of the invention.

The invention relates to a method for generating a freeroom for a mast element in a ground, the method comprising the steps:

a) drilling a first annular recess into the ground, the first recess having:
   - a first diameter; and
   - a first depth;

b) drilling a second annular recess into the ground, the second recess being arranged to receive the mast element, and the second recess:
   - having a diameter which is smaller than the first diameter;
   - having a second depth which is larger than the first depth;
   - surrounding a first core of the ground; and
   - being surrounded by the first recess;

wherein there is, defined between the first recess and the second recess, a second core which can be removed to generate a freeroom.

By a freeroom is understood an open volume between a mast element and a terrain. The freeroom is arranged to give external access to a portion of the mast element for, for example, tools and means that are necessary to position and fix the mast element. It may also be necessary to generate a freeroom to provide a clearance between the mast element and the terrain, for example a mountain or a rock.

The effect of the invention is the ability to generate a defined freeroom only by drilling and hand-held implements, for example a percussion drill, a digging bar and a spade. Thereby the invention eliminates the need for heavy additional equipment, for example an excavator, when a freeroom has to be generated around a drilled recess. This is particularly advantageous when recesses with freerooms are formed where helicopter transport is required.

By using drills suitable for hard ground, for example rock, it is not necessary to use explosives to remove rock mass. The drilling may be performed with one drilling machine with two drills. The drilling may comprise the use of a first slot drill and a second slot drill, wherein the second slot drill has a smaller diameter than the first slot drill. The slot drill may be barrel-shaped. To reduce the transport volume, the sizes of the slot drills may be so adapted that the second slot drill can be transported inside the first slot drill. When drilling with slot drills, an annular recess with an inner surface, an outer surface and a bottom surface is formed.

The first slot drill is adapted for generating an outer boundary for the recess. A circular outer boundary as described herein makes it possible for the recess to be given a base which is smaller and evener than when the recess is formed by the use of an excavator or explosives. Thereby the use of slot drills can reduce the foot print in the terrain and the amount of mass that has to be moved.

The second slot drill is adapted for generating a second recess arranged to receive a mast element. The second recess is deeper than the first recess in order to give the mast element the necessary support in the ground. The second recess is surrounded by the first recess and surrounds a first core.

The two recesses may be arranged concentrically or eccentrically. Between the two recesses, a second core is defined, which can be removed to generate the freeroom. The freeroom comprises a lower bottom surface and an outer boundary surface. The freeroom may have an annular bottom surface. The freeroom may have a sickle-shaped bottom surface.

The material of the second core may be removed manually, for example by using a hand-held drilling machine, a sledgehammer, a digging bar and a spade.

The step b) may be performed before the step a). The first recess may be formed before the second one, or vice versa. The order is determined, to a great extent, by the terrain and the desired depths of the recesses. Forming the first recess first may be advantageous if the second recess is to be formed in two steps, because the second recess may then be formed without changing drills.

The method may include a step c): removing a portion of the first core. When forming a recess for a compact mast element, a portion of the first core may be removed. Removing the first core may make it easier to remove the second core. The first core may be removed before, after or at the same time as the second core. Further, it may be necessary to remove a portion of the first core if the desired depth of the recess is larger than the internal height of the drill. If the drill is short and the recess for the mast element is deep, there may be a need to remove several portions of the core in several turns.

The method may include a step d): deepening the second recess to a third depth, the deepening surrounding a third core. The step d) may be carried out after step b) and/or step c). To give the mast element sufficient support, the second recess may be substantially deeper than the first recess and the bottom surface of the freeroom. To prevent the deepening from becoming filled with drilling dust and mud when the freeroom is being formed, the second recess may be formed in two steps, wherein step 1 comprises drilling to a first depth and step 2 comprises a deepening to a third depth, the deepening being carried out after an overlying material belonging to the first and second cores has been removed.

The deepening surrounds a third core. When receiving a hollow mast element, the first and the second cores may be fully or partially intact and thereby give the mast element an internal support. If the recess is adapted for receiving a solid mast element, the first and third cores are removed.

By the second depth of the second recess being deeper than the first depth of the first recess, a collar and a vertical surface is formed between the freeroom and the second recess. When the second recess is to be deepened to the third depth, the collar can be used as a guide for the slot drill.

The recesses may have been formed with the help of a drill rig. The recesses may have been formed by the use of a drill rig. The drill rig may be a free-standing one and arranged for helicopter transport or transport on a car trailer. The drill rig may be adapted for the attachment of a slot drill. The slot drill may be replaceable.

Before step a), the method may include the step e): positioning and securing the drill rig to the ground. If a light drill rig is used, it may be practical to secure the drill rig to the ground so that it does not unintendedly move during drilling. The invention discloses a method which may comprise drilling with a first slot drill and a second slot drill. Thereby it may be necessary to change the slot drill at least once during the drilling. There are strict requirements for accuracy when positioning and fixing the mast element. If the recess is formed in several steps as described above, a position mark on the surface of the ground may disappear. If the drill rig is secured to the ground, the driveshaft and center axis of the drill rig may be kept in the correct position throughout the drilling process.

The drill rig may be pivotably secured to the ground. A secured drill rig positioned over the recess may be an obstruction if manual work is to be carried out in the recess. The drill rig may be secured to the ground via two anchoring elements. The anchoring elements may include an articulated connection between the drill rig and the ground. The two articulations may form a rotational axis around which the drill rig may be pivoted, so that the drill rig may be laid down. Thereby the drill rig may temporarily be moved away from the recess, while, at the same time, maintenance of the drill rig and a change of drill may be simplified.

BRIEF DESCRIPTION OF THE DRAWINGS

In what follows, an example of a preferred embodiment is described, which is visualized in the accompanying drawings, in which.

DETAILED DESCRIPTION OF THE DRAWINGS

The figures are shown in a simplified and schematic way, and details that are not important to elucidate what is new in the invention may have been left out in the figures. The various elements in the figures are not necessarily shown to scale. Like and corresponding elements will be indicated by the same reference numbers in the figures. Any positional indications (such as "over", "under," "between") refer to positions shown in the figures.

Figure 1:
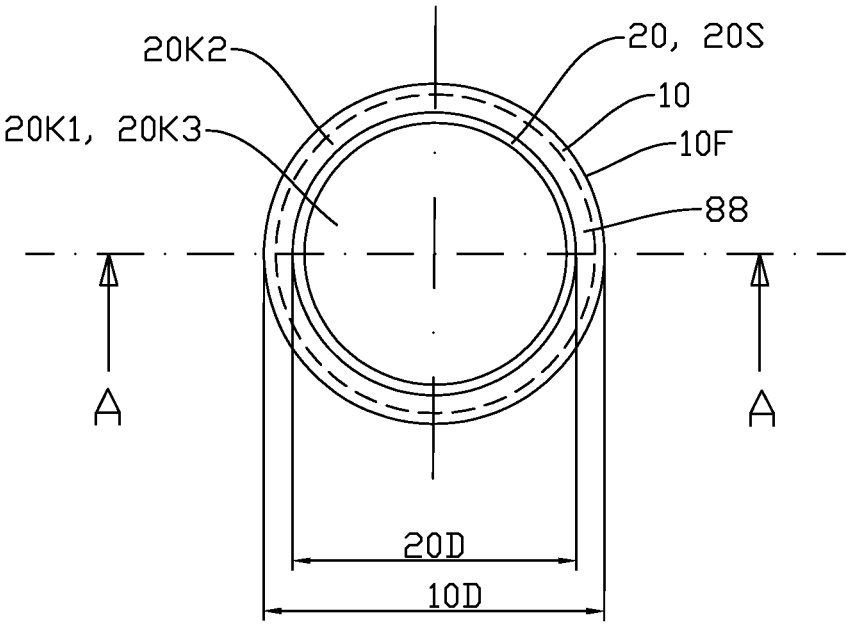
FIG. 1 shows a first exemplary embodiment of a recess according to the invention, from above.
Figure 2:
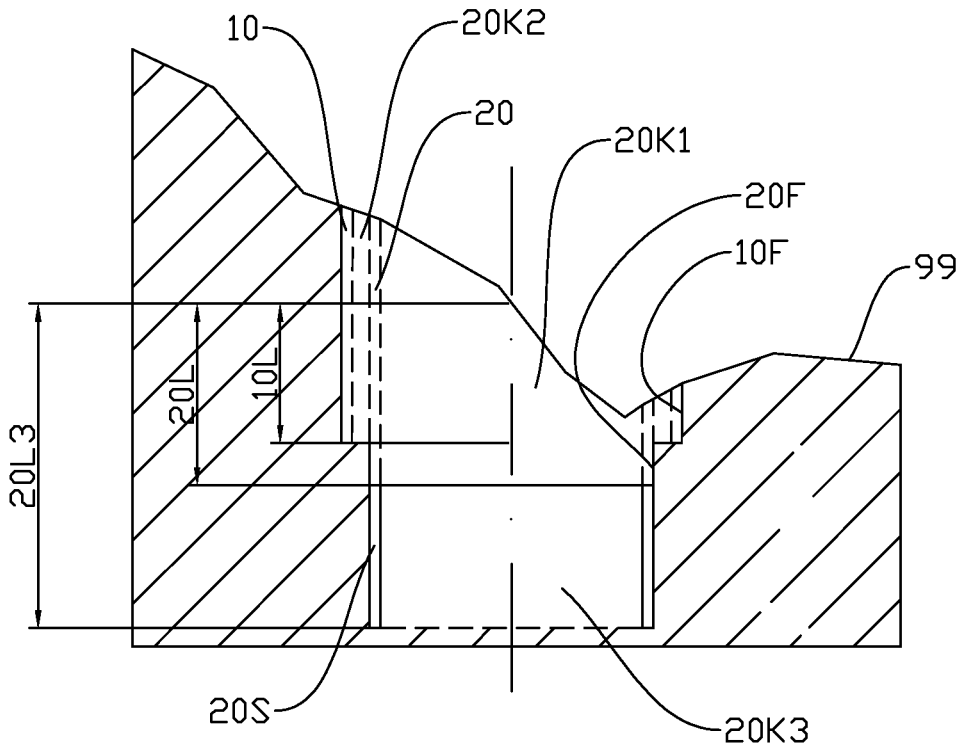
FIG. 2 shows a section of FIG. 1.
Figure 6:
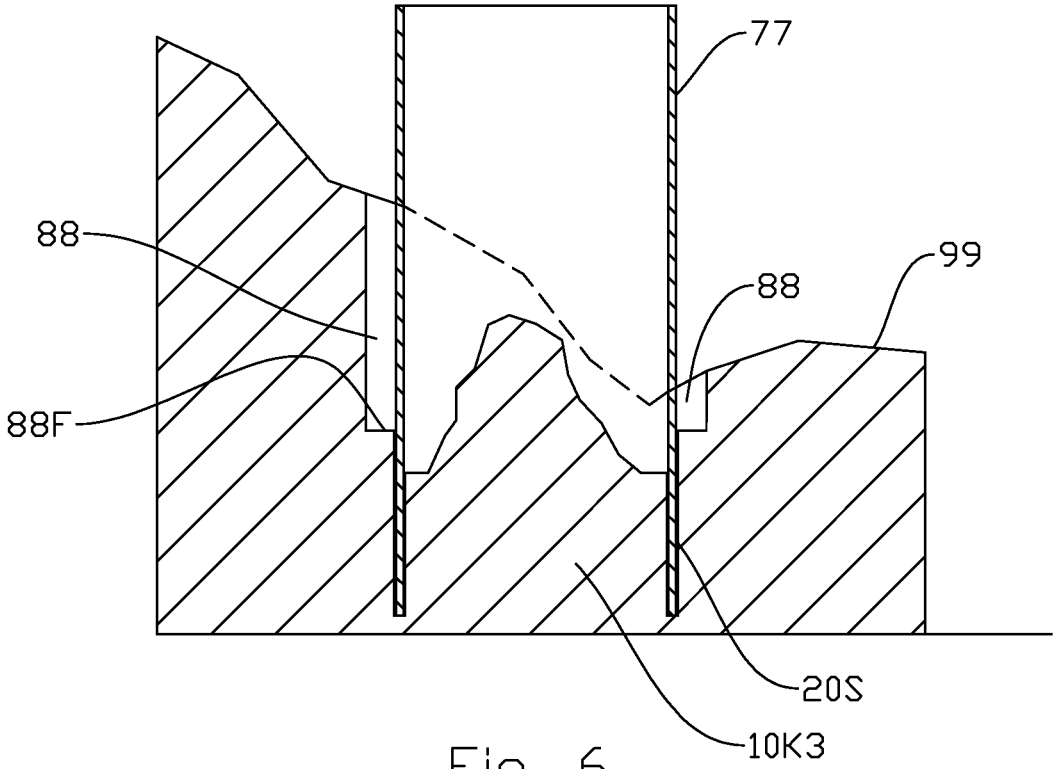
FIG. 6 shows a section of FIG. 5.

FIGS. 1 and 2 show a first exemplary embodiment according to the invention, from above and in a section A-A respectively. A first recess 10 with a first diameter 10D and a first depth 10L gives an outer boundary 10F for the recess. A second recess 20 with a second diameter 20D and a second depth 20L surrounds a first core 20K1. Between the first recess 10 and the second recess 20, a second core 20K2 is defined. By removing the second core 20K2, an annular freeroom 88 is generated between the outer surface 10F of the first recess 10 and the outer surface 20F of the second recess, as a mast element 77 is arranged in the recess 20 (FIG. 6).

The second recess 20 is deepened in a slot portion 20S from the second depth 20L to a third depth 20L3. The slot portion 20S surrounds a third core 20K3.

To prevent drilling dust and mud in the slot portion 20S, the first core 20K1 and the second core 20K2 are removed before the slot portion 20S is formed.

Figure 3:
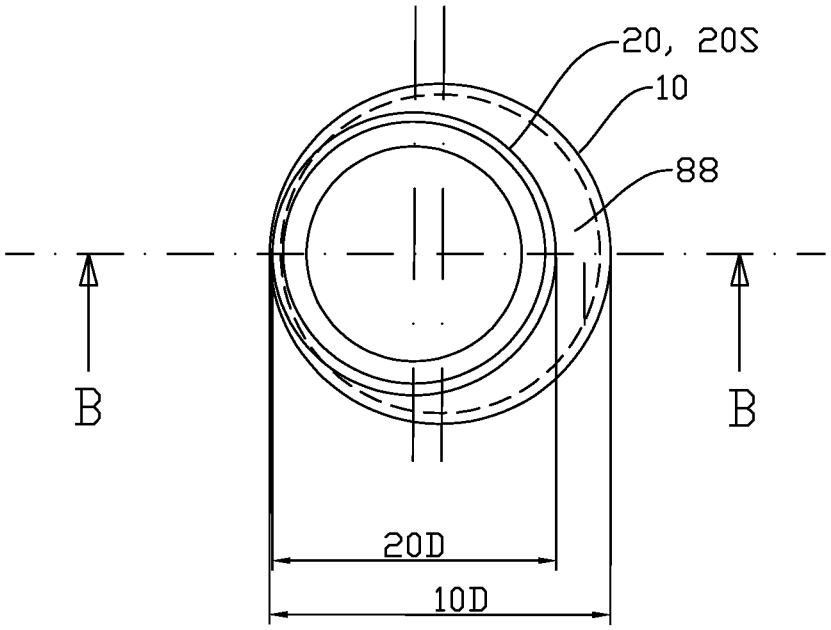
FIG. 3 shows a second exemplary embodiment of a recess for a mast element, from above.
Figure 4:
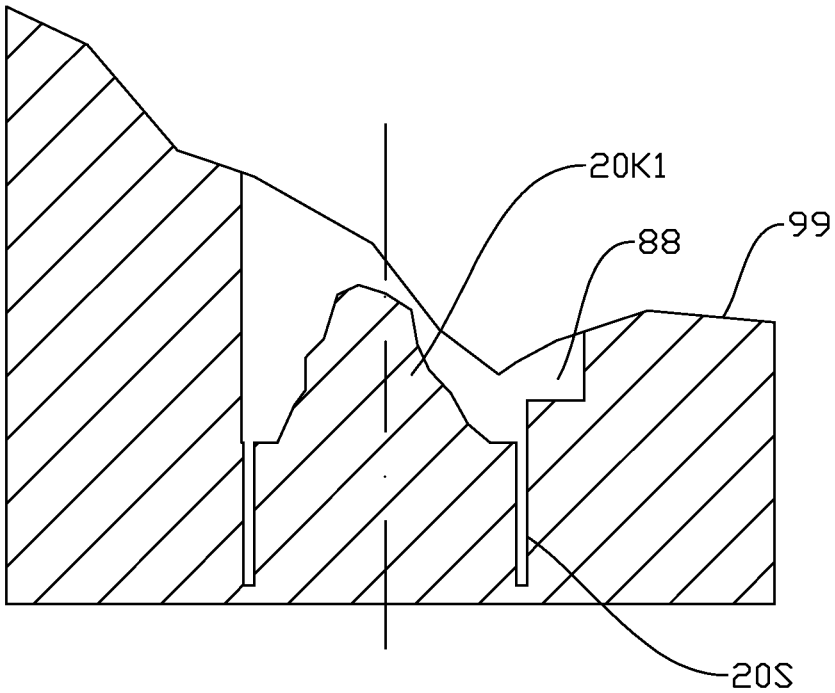
FIG. 4 shows a section of FIG. 3.

FIGS. 3 and 4 show a second exemplary embodiment from above and in a section B-B, respectively. In FIGS. 3 and 4, the first core 20K1 is partially intact and the first recess 10 and the second recess 20 are arranged eccentrically, so that the freeroom 88 will have a sickle-shaped base.

Figure 5:
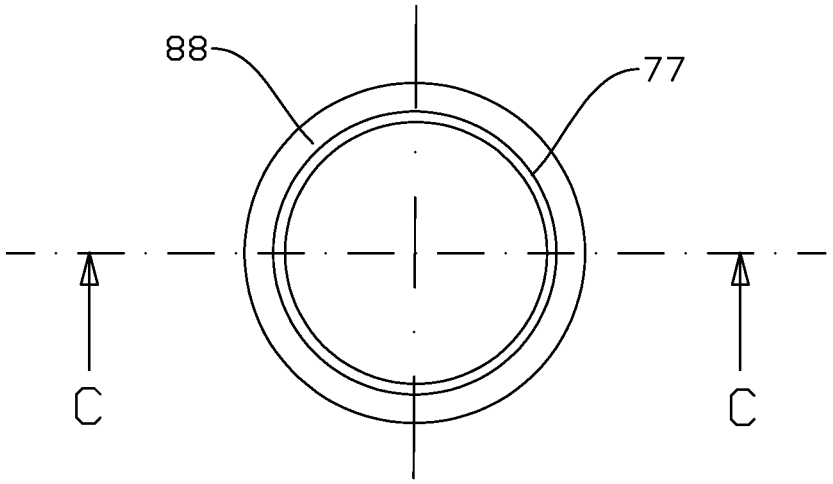
FIG. 5 shows a mast element in a ground, from above.

FIGS. 5 and 6 show, from above and in a section C-C, respectively, a hollow mast element 77 arranged in the second slot portion 20S. The ground 99 gives the mast element 77 an external support, while the third core 10K3 gives the mast element an internal support. The freeroom 88 is annular and provides external access to the mast above the bottom surface 88F of the freeroom.

Figure 7:
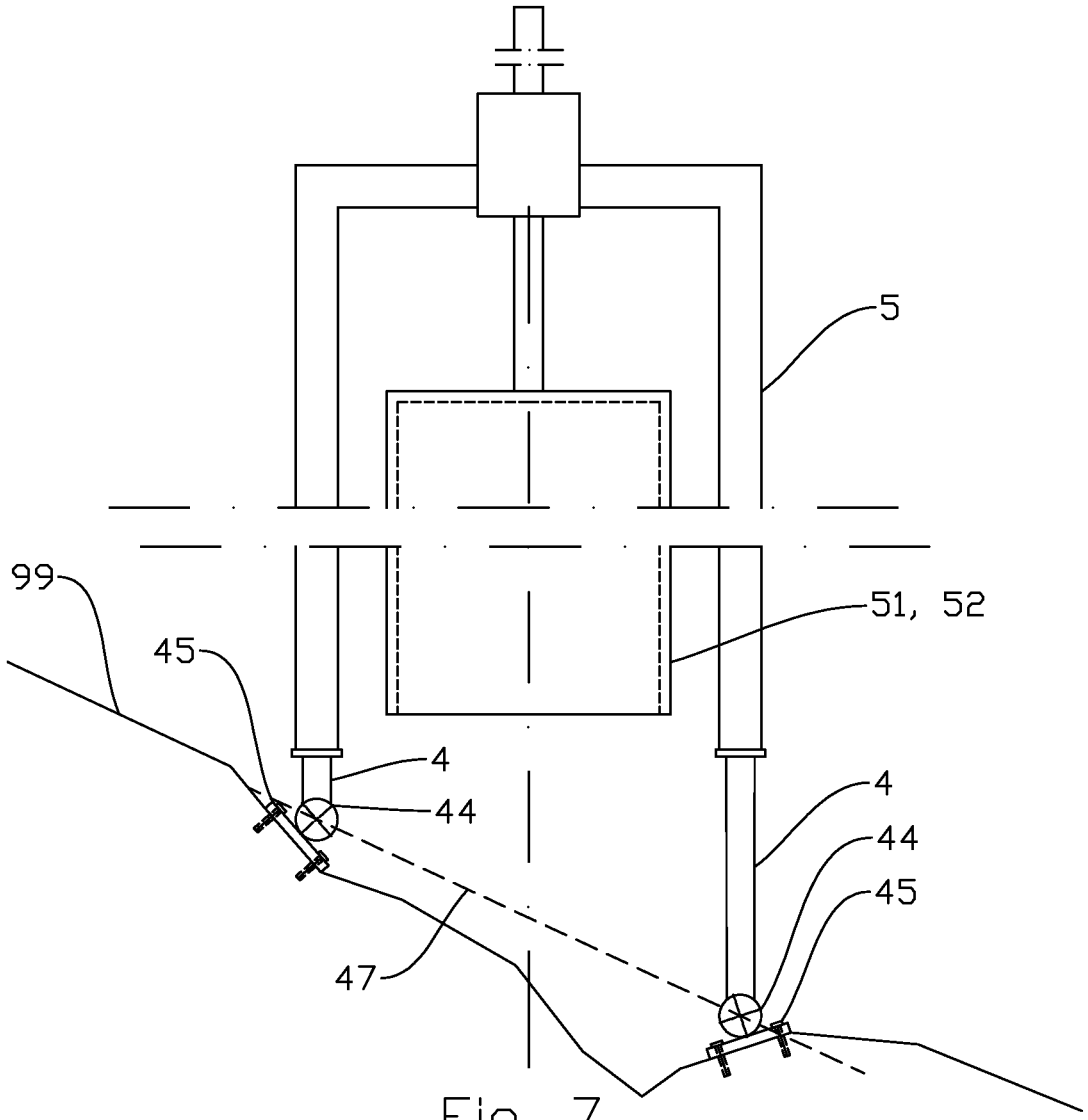
FIG. 7 shows a drill rig in a front view.
Figure 8:
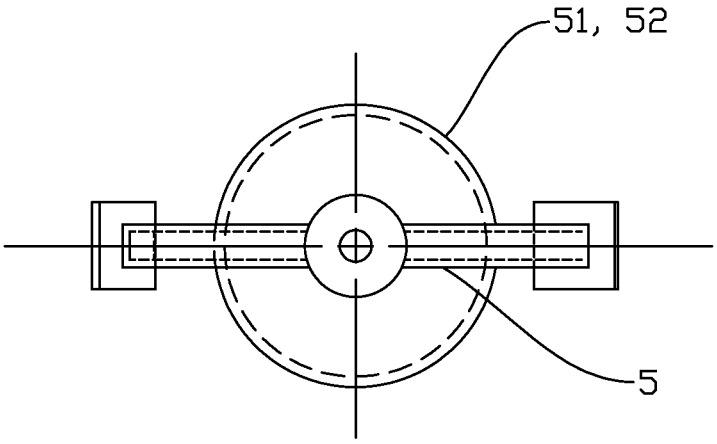
FIG. 8 shows FIG. 7 from above.

FIGS. 7 and 8 show, from the front and from above, respectively, a drill rig 5 suitable for forming the freeroom 88 shown in FIGS. 1-6. The drill rig comprises a replaceable slot drill 51 arranged to form the recesses 10, 20 shown in FIGS. 1-6. The drill rig 5 is secured to the ground 99 via two anchoring elements 4 comprising universal joints 44 and lower coupling portions 45. The lower coupling portion 45 is fixed to the ground 99. The universal joint 44 makes the drill rig 5 pivotable around an axis 47 to facilitate the replacement of a drill 51, 52 and to provide better access when material is to be removed within the recess 10.

It should be noted that all the above-mentioned embodiments illustrate the invention, but do not limit it, and persons skilled in the art may construct many alternative embodiments without departing from the scope of the attached claims.

The use of the verb "to comprise" and its different forms does not exclude the presence of elements or steps that are not mentioned in the claims. The indefinite article "a" or "an" before an element does not exclude the presence of several such elements.

The fact that some features are indicated in mutually different dependent claims does not indicate that a combination of these features cannot be used with advantage.

The invention claimed is:

1. A method for generating a freeroom for a hollow mast element in a ground, the method comprising:

a) drilling a first annular recess into the ground using a drill rig having a first slot drill mounted thereto, the first slot drill being replaceable and having a first diameter, the first annular recess having the first diameter and a first depth; and b) drilling a second annular recess into the ground using the drill rig having a second slot drill mounted thereto instead of the first slot drill, the second slot drill being replaceable and having a second diameter smaller than the first diameter, the second annular recess having the second diameter and a second depth and surrounding a first core of the ground, wherein after drilling the first annular recess and the second annular recess the second depth which is larger than the first depth, the second annular recess is located within the first annular recess, and a second core of the ground is defined between the first annular recess and the second annular recess, and wherein the second annular recess is arranged to receive the hollow mast element with the hollow mast element surrounding the first core of the ground and being surrounded by the first annular recess; and c) generating the freeroom by removing the second core.

2. The method according to claim 1, wherein step b) is performed before step a).

3. The method according to claim 1, wherein the method further includes the step d) removing a portion of the first core.

4. The method according to claim 1, wherein the method includes step e) deepening the second annular recess to a third depth, the second annular recess surrounding a third core at the third depth.

5. The method according to claim 4, wherein the step e) is performed after step b) and step d).

6. The method according to claim 1, wherein the method further comprises, before step a), step d) positioning and securing the drill rig to the ground.

7. The method according to claim 6, wherein the drill rig is pivotably secured to the ground.

8. The method according to claim 2, wherein the method includes step d) removing a portion of the first core.

9. The method according to claim 2, wherein the method includes step d) deepening the second annular recess to a third depth, the second annular recess surrounding a third core at the third depth.

10. The method according to claim 3, wherein the method includes step e) deepening the second annular recess to a third depth, the second annular recess surrounding a third core at the third depth.

11. A method for generating a freeroom for a hollow mast element in a ground, the method comprising:

drilling a first annular recess into the ground, the first annular recess having a first diameter and a first depth;

drilling a second annular recess into the ground, the second annular recess having a second diameter and a second depth, wherein after drilling the first annular recess and the second annular recess the second depth is greater than the first depth and the second diameter is less than the first diameter, wherein a first core of the ground is surrounded by the second annular recess and a second core of the ground is defined between the first annular recess and the second annular recess, and wherein the second annular recess is arranged to receive the hollow mast element such that the hollow mast element surrounds the first core; and generating the freeroom by removing the second core.

12. The method according to claim 11, further comprising positioning the hollow mast element in the second annular recess, wherein the hollow mast element is surrounded by the ground at the second depth.

13. The method according to claim 12, wherein after the hollow mast element is positioned in the second annular recess the hollow mast element is radially separated from the ground at the first depth by the first annular recess and the freeroom.

* * * * *